US007451525B2

(12) United States Patent
Willems

(10) Patent No.: US 7,451,525 B2
(45) Date of Patent: Nov. 18, 2008

(54) SPRUNG SURFACE HANDLE

(75) Inventor: Roger P. Willems, High Wycombe (GB)

(73) Assignee: Penn Elcom, Inc., Garden Grove, CA (US)

( * ) Notice: Subject to any disclaimer, the term of this patent is extended or adjusted under 35 U.S.C. 154(b) by 4 days.

(21) Appl. No.: 11/601,333

(22) Filed: Nov. 17, 2006

(65) Prior Publication Data

US 2007/0062008 A1 Mar. 22, 2007

Related U.S. Application Data

(63) Continuation of application No. 09/997,934, filed on Nov. 30, 2001, now abandoned.

(51) Int. Cl.
*A45C 13/26* (2006.01)

(52) U.S. Cl. ..... 16/445; 16/419; 16/444; 16/408

(58) Field of Classification Search ..... 16/444, 16/445 X, 114.1, 419, 407, 408 X
See application file for complete search history.

(56) References Cited

U.S. PATENT DOCUMENTS 2,715,243 A * 8/1955 Koll ..... 16/445
4,560,190 A * 12/1985 Werner ..... 292/111
5,797,635 A * 8/1998 Willems ..... 292/111

OTHER PUBLICATIONS

Penn Fabrication 1998 Collection, pp. 25-28, published in U.S. in 1998.

U.S. Trademark Registration No. 2,705,977, for configuration of sprung surface handle, registered Apr. 15, 2003.

* cited by examiner

*Primary Examiner*—Patricia Engle
*Assistant Examiner*—Mark Williams
(74) *Attorney, Agent, or Firm*—Robert D. Hornbaker

(57) ABSTRACT

A sprung surface handle for flat surfaces, such as the end of a trunk, or box, comprising a base plate 1 having edges 2, 3, 4; a handle 6 having a cross arm 7, side arms 8, 9, and turned-in arms, or ends, 11, 12; a handle-mounting plate 13 on the base plate 1, having bearings 19, 20 at least partially surrounding the turned-in arms, or ends, 11, 12; a spring 33 to bias handle 6 adjacent base plate 1; stops 21, 22 to engage the side arms 8, 9 to stop rotation of the handle, after it has rotated away from the base plate 1; and raised handle protecting parts 29, 30, 31, 32, on the base plate 1, between the edges 2, 3, 4 thereof and the arms 7, 8, 9, to protect the handle from other objects.

28 Claims, 1 Drawing Sheet

SPRUNG SURFACE HANDLE

This application is a continuation of prior application Ser. No. 09/997,934, filed Nov. 30, 2001 now abandoned.

SUMMARY OF THE INVENTION

Sprung surface handles having arms, for flat surfaces, such as the flat end of a trunk, or box, are well-known in the art, such as Koll U.S. Pat. No. 2,715,243, for a Handle Assembly, patented Aug. 16, 1955. These sprung surface handles protrude from the flat surfaces, and are hazardous, because the arms, or other parts thereof, may engage other objects, such as trunks, boxes, handles or clothing. The present invention provides a base plate having edges, under the handle, with a raised handle-protecting part, or parts, between an edge, or edges, of the plate, and an arm, or arms, of the handle, to protect the handle from other objects. So the primary object of the invention is to eliminate, or reduce, the hazard caused by well-known, protruding sprung surface handles.

PRIOR ART

Willems U.S. Pat. No. 5,797,635, for a Latch, patented Aug. 25, 1998, discloses a latch for holding a pair of case parts together, the latch including a frame 40 having a dish 42 for mounting in a hole in one of the two case parts and a hasp 20 adapted for engaging a strike 16 mounted on the other case part. The hasp 20 has a first end mounted on one end of a slide 70 slidingly mounted on the bracket 50 fixed to the dish 42 and has a second end provided with a catch 26 for engaging the strike 16. A bolt 30 is mounted on the slide to move up and down with the slide, can turn about a bolt axis 64 and has a handle 66 pivotally mounted thereto that enables turning of the bolt to move the hasp 20 until the catch 26 presses firmly down against the strike 16. The bolt 30 is moved in the opposite direction to raise the hasp 20 so that the hasp can pivot out of line with the strike 16. As disclosed in column 3, lines 17-28 of Willems, [t]he dish perimeter 46 includes primarily the flat flange 48 especially at the middle top 122 and middle bottom 124, where the hasp lies in its use and stowed positions. The perimeter also has six projecting parts 130 that help strengthen the dish perimeter and that also provide rounded bumps that keep objects away from the dish so they are less likely to engage other parts of the latch that could harm a person or another package. The projecting parts include four parts 127 at the four corners of the rectangular flange, and two vertically elongated projecting parts 128 at the laterally opposite sides of the flange. The projecting parts project by more than twice the thickness T of the sheet metal.

WRITTEN DESCRIPTION OF THE INVENTION

Figures 1, 2, 3, 4, 5:
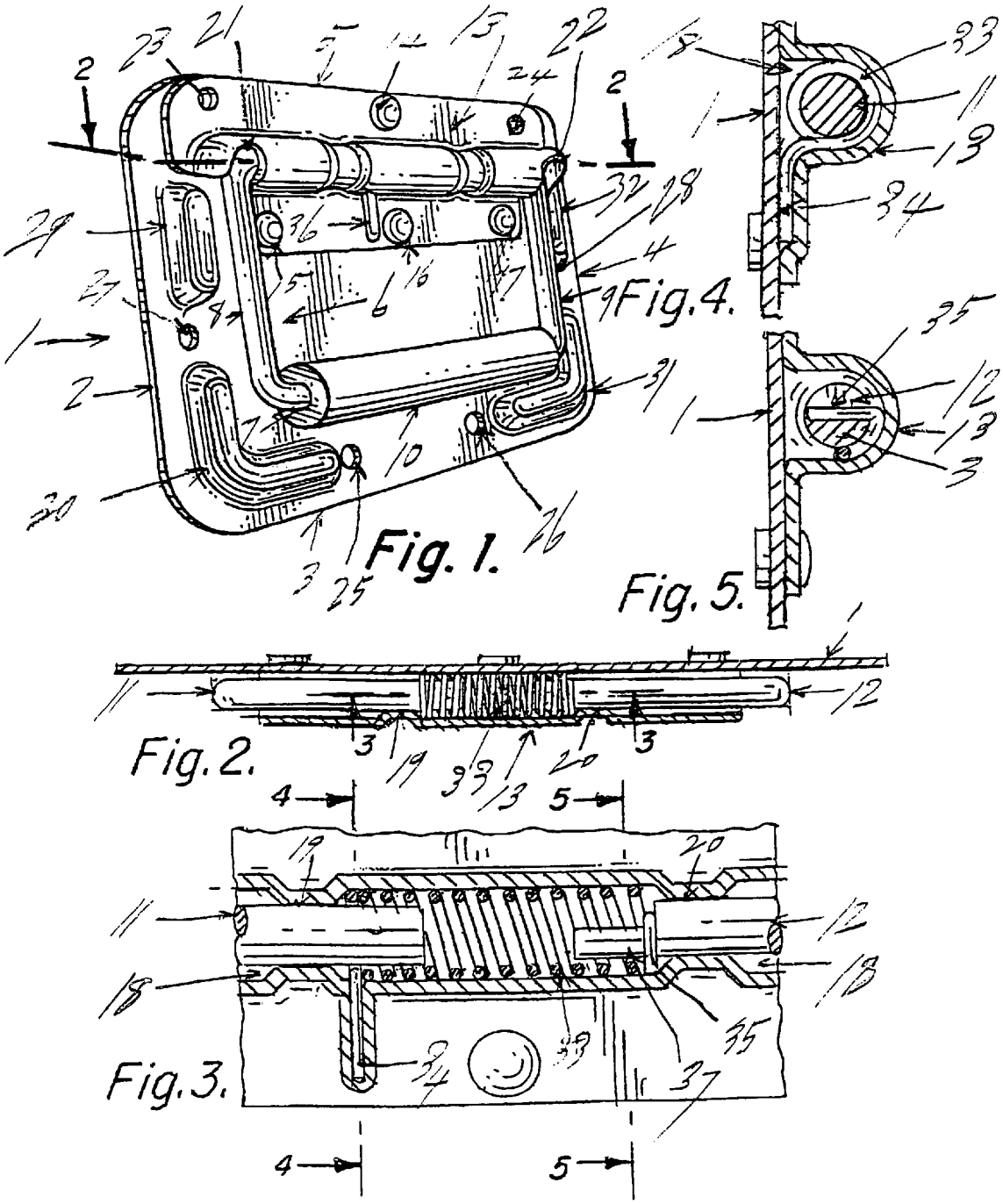
FIG. 1 is a perspective view.
FIG. 2 is a cross-sectional view along the lines 2-2 of FIG. 1, showing the spring, and turned-in arms, or ends, in the channel of the handle-mounting plate.
FIG. 3 is a cross-sectional view along the lines 3-3 of FIG. 2, showing the spring, and bearing surfaces, in the channel of the handle-mounting plate, with the bearing surfaces at least partially surrounding the turned-in arms, or ends, of the handle.
FIG. 4 is a cross-sectional view along the lines 4-4 of FIG. 3, showing one end of the spring, in a groove, in the bottom of the handle-mounting plate, between the base plate and the handle-mounting plate.
FIG. 5 is a cross-sectional view along the lines 5-5 of FIG. 3, showing the other end of the spring connected to a turned-in arm, or end, of the handle.

As best shown in FIG. 1, the handle assembly has a base plate 1 having edges 2, 3, 4, 5. The handle assembly also includes a handle 6 having a cross arm 7, first and second side arms 8, 9, and a grip 10, on the cross arm 7. While grip 10 makes it easier to grasp the handle 6, it is not an essential part of the invention, because one could grasp cross arm 7. FIGS. 2 and 3 show that handle 6 also has first and second turned-in, coaxial arms, or ends, 11, 12, extending inwardly from the first and second side arms 8, 9. While handle 6 is shown, and described, as having arms 7, 8, 9, 11, 12 at right angles, other handle shapes may be used. For example, arms 7, 8, 9 could be a continuous curve.

A handle-mounting plate 13, on the base plate 1, is attached thereto by rivets 14, 15, 16, 17, as best shown in FIG. 1. However, handle-mounting plate 13, on the base plate 1, may be attached thereto by other means, such as spot welding, or the handle-mounting plate 13 and base plate 1 may be formed of one piece, with the handle-mounting plate 13 bent over on the base plate 1, thereby eliminating the need for rivet 14, or spot welding, in place of rivet 14. So a handle mounting plate 13, on said base plate 1, includes attachment by rivets, spot welding, or formed of one piece, with the handle-mounting plate 13 bent over on the base plate 1.

FIGS. 2 and 3 show handle-mounting plate 13 has a channel 18 formed therein, the channel 18 having first and second internal bearing surfaces 19, 20, the first internal bearing surface 19 at least partially surrounding the first turned-in arm, or end, 11, and the second internal bearing surface 20 at least partially surrounding the second turned-in arm, or end, 12. So the turned-in arms, or ends, 11, 12 rotate in the internal bearing surfaces 19, 20, to a position in which the handle 6 is adjacent the base plate 1, as shown in FIG. 1. In that position, the handle 6 does not contact the base plate, but is near it, separated therefrom by the thickness of the grip 10. A handle 6, without grip 10, would contact the base plate 1, and would be more difficult to grasp. Nevertheless, as used herein, adjacent means near the base plate 1, or in contact with it.

First and second curved stops 21, 22, shown in FIG. 1, are formed at the ends of the channel 18, in the handle mounting plate 13, so the first curved stop 21 receives the first side arm 8, and the second curved stop 22 receives the second side arm 9, to stop rotation of the handle 6, when it is rotated away from the base plate 1, to an upright position, that is, with the side arms 8, 9 approximately perpendicular to the base plate 1. In this position, the handle transmits a lifting force, on the cross arm 7, or grip 10, to the end of a trunk, or box, through bolts, or rivets, in the holes 23, 24, 25, 26, 27, 28. The lifting force, on the cross arm 7, or grip 10, exerts a torque on the base plate 1 that tends to pull it off the trunk, or box. Opposing torques are exerted by the tensile forces on the rivets, or bolts, in the holes 23, 24, 25, 26, 27, 28, which are equal to the tensile force on each bolt, or rivet, times its lever arm, the distance to its axis of rotation, or the perpendicular distance from the center of each of the holes 23, 24, 25, 26, 27, 28 to the upper edge 5 of the base plate 1. The sum of these opposing torques are equal to the torque caused by the lifting force on the cross arm 7, or grip 10. Since the plate 1 provides long lever arms for the bolts, or rivets, in holes 25, 26, 27, 28, the base plate 1 is secure, and not likely to be loosened, or pulled off the trunk, or box, because the tensile force on each rivet, or bolt, in holes 25, 26, 27, 28, is much less than the lifting force. While I have described the curved stops 21, 22 as stopping rotation, when the handle is rotated to an upright position, the stops could be formed to stop the rotation at any time after the handle 6 has rotated away from the base plate 1.

Although curved stops 21, 22 are shown, and described, as formed in the handle-mounting plate 13, they could be formed on the handle-mounting plate 13. So, as used herein, in includes on, and vice versa. Also, while the curved stops 21, 22 are shown, and described, at the end of channel 18, in handle-mounting plate 13, if part of the handle-mounting plate 13, at the end, or ends, of channel 18 are removed, the first curved stop 21, or the second curved stop 22, or both, could be formed on the base plate 1. In addition, although the curved stops 21, 22 are shown, and described, as curved, other shapes could be used, in, or on, the handle-mounting plate 13, or on the base plate 1.

Raised handle-protecting parts 29, 30, 31, 32 are formed in the base plate 1, by stamping, but could be separate parts, on the base plate 1, attached by bolts, or other means. Raised handle-protecting part 29 is between side arm 8 and edge 2, raised handle-protecting part 30 is between side arm 8 and edge 2, and also between cross arm 7 and edge 3. Likewise, raised handle-protecting part 32 is between side arm 9 and edge 4, and handle-protecting part 31 is between side arm 9 and edge 4, and also between cross arm 7 and edge 3. While these preferred handle-protecting parts 29, 30, 31, 32 protect the side arms 8, 9, cross arm 7, and grip 10, as well as the corner formed by side arm 8 and cross arm 7, and the corner formed by the side arm 9 and cross arm 7, alternative handle-protecting parts may be used. For example, one handle protecting part could be between cross arm 7 and the edge 3, or one handle-protecting part could be between the side arm 8 and edge 2, or one handle-protecting part could be between the side arm 9 and edge 4, or any combination of two of these handle-protecting parts could be used instead of any one alone, or all three could be used instead of any one, or any two, alone.

While the preferred handle-protecting parts have a smooth, sloping surface, as shown in FIG. 1, other surfaces, without edges, or corners, that will not snag, or catch, on trunks, boxes, handles, or clothing may be used. Preferably, handle-protecting parts 29, 30, 31, 32 extend from the base plate 1 to at least the top of the cross arm 7, when the handle is adjacent the base plate 1. Obviously, higher, or lower, handle-protecting parts will also work.

A coil spring 33 having first and second ends 34, 35, in the channel 18, biases the handle 6 adjacent base plate 1, as shown in FIG. 1. The first end 34 of the coil spring 33 is in a groove 36, in the bottom surface of the handle mounting plate 13, between the base plate 1 and the handle mounting plate 13. The second end 35 of the coil spring 36 fits tightly over an extension 37 of the turned-in arm, or end, 12, to bias handle 6 adjacent base plate 1. While the groove 36 is shown, and described, in the bottom surface of handle-mounting plate 13, it could be in the top surface of base plate 1. Also, the first end 34 of the coil spring 33 could otherwise be connected to the base plate 1, and handle-mounting plate 13, and second end 35 of the coil spring 33 could otherwise be connected to the turned-in arm, or end, 12. Likewise, the handle 6 could be otherwise biased adjacent base plate 1 by a leaf spring.

Although particular embodiments of the invention have been shown, and described, herein, modifications and variations may readily occur to persons having ordinary skill in the art, and, consequently, it is intended that the claims be interpreted to cover such modifications and equivalents.

The invention claimed is:

1. A sprung surface handle comprising:

a base plate having edges;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate; and a raised handle-protecting part, on said base plate, between an edge thereof and at least one arm of said handle, when said cross arm is adjacent said base plate.

2. The sprung surface handle recited in claim 1, further comprising a stop, in said handle-mounting plate, adapted to engage at least one of said side arms, to stop rotation of the handle, after it has rotated away from said base plate.

3. The sprung surface handle recited in claim 1, further comprising a stop, on said base plate, adapted to engage at least one of said side arms, to stop rotation of the handle, after it has rotated away from said base plate.

4. A sprung surface handle comprising:

a base plate having edges;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate; and a raised handle-protecting part, on said base plate, between an edge thereof and said cross arm, when said cross arm is adjacent said base plate.

5. The sprung surface handle recited in claim 4, further comprising a stop, in said handle-mounting plate, adapted to engage at least one of said side arms, to stop rotation of the handle, after it has rotated away from said base plate.

6. The sprung surface handle recited in claim 4, further comprising a stop, on said base plate, adapted to engage at least one of said side arms, to stop rotation of the handle, after it has rotated away from said base plate.

7. A sprung surface handle comprising:

a base plate having edges;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate; and raised handle-protecting parts, on said base plate, between an edge thereof and said first side arm, and between an edge thereof and said second side arm, when said cross arm is adjacent said base plate.

8. The sprung surface handle recited in claim 7, further comprising a stop in said handle-mounting plate, adapted to engage at least one of said side arms, to stop rotation of the handle, after it has rotated away from said base plate.

9. The sprung surface handle recited in claim 7, further comprising a stop, on said base plate, adapted to engage at least one of said side arms, to stop rotation of the handle, after it has rotated away from said base plate.

10. A sprung surface handle comprising:

a base plate having edges;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate; and raised handle-protecting parts, on said base plate, between an edge of said base plate and said cross arm, between an edge of said base plate and said first side arm, and between an edge of said base plate and said second side arm, when said cross arm is adjacent said base plate.

11. The sprung surface handle recited in claim 10, further comprising a stop, in said handle-mounting plate, adapted to engage at least one of said side arms, to stop rotation of the handle, after it has rotated away from said base plate.

12. The sprung surface handle recited in claim 10, further comprising a stop, on said base plate, adapted to engage at least one of said side arms, to stop rotation of the handle, after it has rotated away from said base plate.

13. A sprung surface handle comprising:

a base plate having edges;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate, said handle-mounting plate also having a groove in the bottom surface thereof;

a stop, in said handle-mounting plate, adapted to engage at least one of said side arms, to stop rotation of the handle, after it has rotated away from said base plate;

a spring having first and second ends, in said channel, said spring having said first end in said groove, between said base plate and said handle mounting plate, and said second end connected to one of the turned-in ends, to bias said handle adjacent said base plate; and a raised handle-protecting part, on said base plate, between an edge thereof and at least one arm of said handle, when said cross arm is adjacent said base plate.

14. The sprung surface handle recited in claim 13 wherein said stop is on said base plate.

15. A sprung surface handle comprising:

a base plate having edges;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate, said handle mounting plate also having a groove in the bottom surface thereof;

a stop, in said handle-mounting plate, adapted to engage at least one of said side arms, to stop rotation of the handle, after it has rotated away from said base plate;

a spring having first and second ends, in said channel, said spring having said first end in said groove, between said base plate and said handle-mounting plate, and said second end connected to one of the turned-in ends, to bias said handle adjacent said base plate; and a raised handle-protecting part, on said base plate, between an edge thereof and said cross arm, when said cross arm is adjacent said base plate.

16. The sprung surface handle recited in claim 15 wherein said stop is on said base plate.

17. A sprung surface handle comprising;

a base plate having edges;

a handle having a cross arm, first and second side arms, and first and second turned-in coaxial arms, or ends, extending from said first and second side arms;

a handle-mounting plate on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate, said handle mounting plate also having a groove in the bottom surface thereof;

a stop, in said handle-mounting plate, adapted to engage at least one of said side arms, to prevent rotation of the handle, after it has rotated away from said base plate;

a spring having first and second ends, in said channel, said spring having said first end in said groove, between said base plate and said handle mounting plate, and said second end connected to one of the turned-in ends, to bias said handle adjacent said base plate; and raised handle-protecting parts, on said base plate, between an edge thereof and said first side arm, and between an edge thereof and said second side arm, when said cross arm is adjacent said base plate.

18. The sprung surface handle recited in claim 17 wherein said stop is on said base plate.

19. A sprung surface handle comprising:

a base plate having edges;

a handle having a cross arm, first and second said arms, and first and second turned-in coaxial arms, or ends, extending from said first and second side arms;

a handle-mounting plate, on said base plate, said handle mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate, said handle-mounting plate also having a groove in the bottom surface thereof;

a stop, in said handle-mounting plate, adapted to engage one of said side arms, to stop rotation of the handle, after it has rotated away from said base plate;

a spring having first and second ends, in said channel, said spring having said first end in said groove, between said base plate and said handle-mounting plate, and said second end connected to one of the turned-in ends, to bias said handle adjacent said base plate; and raised handle-protecting parts, on said base plate, between an edge of said base plate and said cross arm, between an edge of said base plate and said first side arm, and between an edge of said base plate and said second side arm, when said cross arm is adjacent said base plate.

20. The sprung surface handle recited in claim 19 wherein said stop is on said base plate.

21. A sprung surface handle comprising:

a base plate having edges, said base plate also having a groove in the top surface thereof;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate;

a stop, in said handle-mounting plate, adapted to engage at least one of said side arms, to stop rotation of the handle, after it has rotated away from said base plate;

a spring having first and second ends, in said channel, said spring having said first end in said groove, between said base plate and said handle mounting plate, and said second end connected to one of the turned-in ends, to bias said handle adjacent said base plate; and a raised handle-protecting part, on said base plate, between an edge thereof and at least one arm of said handle, when said cross arm is adjacent said base plate.

22. The sprung surface handle recited in claim 21 wherein said stop is on said base plate.

23. A sprung surface handle comprising:

a base plate having edges, said base plate also having a groove in the top surface thereof;

a handle having a cross arm, first and second side arms, and first and second turned-in coaxial arms, or ends, extending from said first and second side arms;

a handle-mounting plate, on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate;

a stop, in said handle-mounting plate, adapted to engage at least one of said side arms, to stop rotation of the handle, after it has rotated away from said base plate;

a spring having first and second ends, in said channel, said spring having said first end in said groove, between said base plate and said handle-mounting plate, and said second end connected to one of the turned-in ends, to bias said handle adjacent said base plate; and a raised handle-protecting part, on said base plate, between an edge thereof and said cross arm, when said cross arm is adjacent said base plate.

24. The sprung surface handle recited in claim 23 wherein said stop is on said base plate.

25. A sprung surface handle comprising;

a base plate having edges, said base plate also having a groove in the top surface thereof;

a handle having a cross arm, first and second side arms, and first and second turned-in coaxial arms, or ends, extending from said first and second side arms;

a handle-mounting plate on said base plate, said handle-mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate;

a stop, in said handle-mounting plate, adapted to engage at least one of said side arms, to prevent rotation of the handle, after it has rotated away from said base plate;

a spring having first and second ends, in said channel, said spring having said first end in said groove, between said base plate and said handle mounting plate, and said second end connected to one of the turned-in ends, to bias said handle adjacent said base plate; and raised handle-protecting parts, on said base plate, between an edge thereof and said first side arm, and between an edge thereof and said second side arm, when said cross arm is adjacent said base plate.

26. The sprung surface handle recited in claim 25 wherein said stop is on said base plate.

27. A sprung surface handle comprising:

a base plate having edges, said base plate also having a groove in the top surface thereof;

a handle having a cross arm, first and second said arms, and first and second turned-in coaxial arms, or ends, extending from said first and second side arms;

a handle-mounting plate, on said base plate, said handle mounting plate having a channel formed therein, said channel having first and second internal bearing surfaces, said first internal bearing surface at least partially surrounding said first turned-in end, and said second bearing surface at least partially surrounding said second turned-in end, said turned-in ends being rotatable in said bearing surfaces to a position in which said cross arm is adjacent said base plate;

a stop, in said handle-mounting plate, adapted to engage one of said side arms, to stop rotation of the handle, after it has rotated away from said base plate;

a spring having first and second ends, in said channel, said spring having said first end in said groove, between said base plate and said handle-mounting plate, and said second end connected to one of the turned-in ends, to bias said handle adjacent said base plate; and raised handle-protecting parts, on said base plate, between an edge of said base plate and said cross arm, between an edge of said base plate and said first side arm, and between an edge of said base plate and said second side arm, when said cross arm is adjacent said base plate.

28. The sprung surface handle recited in claim 27 wherein said stop is on said base plate.

* * * * *